US007258232B2

(12) United States Patent
Bradford et al.

(10) Patent No.: US 7,258,232 B2
(45) Date of Patent: Aug. 21, 2007

(54) PARTIALLY COLLAPSIBLE AND PARTIALLY EXPANDABLE DUNNAGE SYSTEM FOR USE IN A HORIZONTAL DISPENSING CONTAINER

(75) Inventors: Judson A. Bradford, Holland, MI (US); Calvin D. Nyeboer, Holland, MI (US); Donald J. Bazany, Grand Haven, MI (US)

(73) Assignee: Bradford Company, Holland, MI (US)

( * ) Notice: Subject to any disclaimer, the term of this patent is extended or adjusted under 35 U.S.C. 154(b) by 339 days.

(21) Appl. No.: 10/965,053

(22) Filed: Oct. 14, 2004

(65) Prior Publication Data

US 2006/0081490 A1 Apr. 20, 2006

(51) Int. Cl.
*B65D 19/00* (2006.01)

(52) U.S. Cl. ..... 206/386; 206/583; 206/600; 220/4.28; 220/6; 220/500; 220/559; 312/3; 312/6; 410/43

(58) Field of Classification Search ..... 206/386, 206/583; 211/59.3; 383/2, 38, 43, 44; 221/64, 221/65, 175, 176; 220/6, 559; 190/130, 190/104; 414/913, 922–926; 410/30–32
See application file for complete search history.

(56) References Cited

U.S. PATENT DOCUMENTS 1,225,609 A 2/1917 Ford et al.
3,666,114 A 5/1972 David
5,161,702 A * 11/1992 Skalski ..... 211/59.3
5,626,206 A 5/1997 Weber et al.
5,725,118 A * 3/1998 Slager et al. ..... 220/4.28
5,725,119 A * 3/1998 Bradford et al. ..... 220/6
6,035,973 A 3/2000 Neal et al.
6,044,932 A 4/2000 Neal et al.
6,062,410 A 5/2000 Bradford et al.
6,230,916 B1 5/2001 Bradford et al.
6,296,133 B1 10/2001 Cobane
6,364,330 B1 4/2002 Weber et al.
6,450,360 B1 9/2002 Hyde
6,497,542 B1 * 12/2002 Vermeulen ..... 410/43
6,540,096 B1 4/2003 Bazany et al.
6,601,928 B1 * 8/2003 Kortman et al. ..... 312/3
6,719,157 B2 4/2004 Stoddart et al.
2002/0175166 A1 11/2002 Robinson et al.

* cited by examiner

*Primary Examiner*—Mickey Yu
*Assistant Examiner*—Steven Pollicoff
(74) *Attorney, Agent, or Firm*—Wood, Herron & Evans, LLP

(57) ABSTRACT

A partially collapsible and partially expandable dunnage system is provided for use in a horizontal dispensing container. The dunnage comprises a plurality of cells for storing and transporting parts. The dunnage system includes at least two constant force springs secured to the dunnage. The dunnage system provides horizontal access to product inside the container in an ergonomically friendly zone so a worker need not bend over to remove or insert product from the cells.

23 Claims, 13 Drawing Sheets

PARTIALLY COLLAPSIBLE AND PARTIALLY EXPANDABLE DUNNAGE SYSTEM FOR USE IN A HORIZONTAL DISPENSING CONTAINER

FIELD OF THE INVENTION

This invention relates generally to dunnage for use in shipping containers, and more particularly, to dunnage which is partially collapsible and partially expandable inside a horizontal dispensing container.

BACKGROUND OF THE INVENTION

A large number of different container structures are utilized by manufacturers to ship a variety of different products to end users, which may be, for example, assembly plants. In the automobile industry for example, an assembly plant assembling a particular automobile might utilize a number of different parts from different manufacturers. These manufacturers ship their respective parts to the assembly plant in container structures where the parts are then removed from dunnage inside the container structure and assembled into a finished automobile.

Access to the product in the containers is of particular concern. Specifically, in the automotive industry, the containers full of product are positioned on an assembly line adjacent to a work area which is associated with a particular product to be installed on a manufactured vehicle. For example, a container full of interior door panels is usually positioned next to a particular station on an assembly line where interior door panels are installed so that a line worker may easily access the door panels inside the container. The product or part is taken directly from the container and used on the line. Some existing containers are difficult to access which makes removal of the parts therein difficult and time consuming. As may be appreciated, a line worker only has a certain amount of time to install a part. Any delay in access and removal of the part from the container is undesirable.

For easy access, containers may be designed to be entered from the side, as opposed to the top, so that a user or line worker may remove parts horizontally rather than vertically. Horizontal removal of parts may be easier for an assembly line worker than vertical removal of parts, especially if the process is repeated many times. U.S. Pat. Nos. 6,230,916; 6,062,410 and 6,540,096, all owned by the assignee and fully incorporated herein, disclose reusable horizontal dispensing containers having integral dunnage. The repetitive motion of accessing parts to install on a finished product such as an automobile should not be difficult or straining to a line worker since it must be done many times during a shift.

In many containers, a line worker or employee inserts or removes parts from a lower or bottom part of the container. This movement by the line worker is known in the industry as "pearl diving" because the line worker must lean forward and bend down into the container to insert or remove a part or work piece from the bottom of the container. This movement is necessary with most top loading containers.

Depending upon the number of times the line worker repeats this motion of "pearl diving" into the interior of the container, strain in the back, legs and arms may result. The size and/or weight of the parts or work pieces may increase the strain on the line worker. Thus, "pearl diving" may cause physical trauma, pain and other injuries that may lead to lost production time.

Several devices have been developed for use in containers in order to reduce the frequency of "pear diving" by an employee. For example, U.S. Pat. No. 6,450,360 discloses a spring-loaded tube assembly which raises the parts located on a platform inside a container to a location in which the worker need not "pearl dive" to insert or remove parts from the container.

Related U.S. Pat. Nos. 5,626,206; 6,035,973 and 6,044,932 disclose devices for ergonomically removing parts from a container which uses constant rate coil springs to raise a platform on which the parts reside. The coil springs have spring constants chosen to correspond to the weight of the parts inside the container. One drawback of these ergonomic devices is that a platform must be used in the containers. Another drawback of these ergonomic devices is that with repeated use over time, the coil springs may wear out and fail to function properly.

Accordingly, there is a need for a collapsible and expandable dunnage system for use in a horizontal dispensing container which prevents employees from "pearl diving".

There is further a need for a collapsible and expandable dunnage system for use in a horizontal dispensing container which may designed for a particular application.

There is further a need for a collapsible and expandable dunnage system for use in a horizontal dispensing container to bring product into an ergonomically friendly area or zone.

SUMMARY OF THE INVENTION

The present invention is directed to a partially collapsible and partially expandable dunnage system for use in a horizontal dispensing container. One horizontal dispensing container which may be used in accordance with the present invention is disclosed in U.S. Pat. No. 6,540,096, which is fully incorporated herein. Another horizontal dispensing container which may be used with the present invention is disclosed in U.S. patent application Ser. No. 10/761,013 filed Jan. 20, 2004, which is fully incorporate by reference herein. However, the present invention may be used in accordance with any horizontal dispensing container. The horizontal dispensing container may allow access from one side or from opposite sides of the container.

The present invention provides a dunnage system for use in a horizontal dispensing container. A portion of the dunnage expands or collapses depending upon the combined weight of product located inside cells or compartments of the dunnage. The dunnage is made of a flexible material and comprises at least one vertically oriented column of compartments or cells. In one preferred embodiment, the dunnage comprises only one column of compartments. In another preferred embodiment, the dunnage comprises multiple integral columns of compartments. Each compartment is defined by a pair of sidewalls, an upper wall and a lower wall. The dunnage of the present invention may assume other configurations or designs with departing from the spirit of the invention.

A plurality of constant force springs are additional components of the dunnage system of the present invention. Each of the constant force springs is movable between an extended position or condition and a collapsed position or condition and is partially wrapped around a brace, even when extended. Each of the constant force springs is selected to expand when a predetermined amount of force is applied to the spring. The constant force springs may be any desired width and may be made of any material such as stainless steel, for example. One manufacturer of such constant force springs is Vulcan Spring. See www.vulcanspring.com.

In one preferred embodiment, the collapsible, expandable dunnage system further comprises supports extending between opposite sides of the horizontal dispensing container for supporting the dunnage. The supports may extend from side to side or from back to front of the horizontal dispensing container, depending upon the desired application. The supports are preferably located proximate the top of the container; however, they may be located in any desired location. The partially collapsible, partially expandable dunnage may be partly or entirely supported from one or more of such supports. In one preferred embodiment, the supports for supporting the dunnage may be integral with a removable cover of the container.

The collapsible, expandable dunnage system of the present invention further comprises braces extending between opposite sides of the horizontal dispensing container. The braces may extend from side to side or from back to front of the horizontal dispensing container, depending upon the desired application. The braces are preferably located proximate the top of the container; however, they may be located in any desired location. Each of the constant rate springs is at least partially wrapped around one of these braces. In one preferred embodiment, the braces are cylindrical rods around which the constant rate springs are wrapped. The constant force springs are more fully wrapped around the braces when in their collapsed position compared to when the constant force spring are in their extended position. In one preferred embodiment, the braces for supporting the constant rate springs may be integral with a removable cover of the container.

One method of using the partially collapsible, partially expandable dunnage system of the present invention comprises first loading or filling the dunnage with product or parts. When the dunnage compartments are empty, the dunnage is partially collapsed in a partially collapsed condition. In this condition, only select compartments, i.e. the lower compartments of a column of compartments are accessible to the user. The other compartments above the exposed, accessible compartments are collapsed and therefore unaccessible. Due to the effect of the constant force springs on the dunnage, the exposed dunnage compartments available for loading are in an ergonomically friendly area or zone in which the user need not "pear dive" or bend over to insert parts into the open or exposed dunnage compartments. Therefore, the user is able to insert product or parts into exposed compartments which are located in this ergonomically friendly area or zone. The user may choose to begin loading parts into the exposed compartments starting at the bottom or lower most compartment and working his or her way up. Alternative methods of filling these exposed compartments located in this ergonomically friendly area or zone may utilized if desired.

When the combined weight of the parts or products in the compartments exceeds a predetermined value, the constant force springs partially expand to the extent permitted by the length of the columns of dunnage. The combined force exerted on the constant force springs by the combined weight of the product or parts causes this partial expansion of the constant force springs. The constant force springs do not fully expand, they partially expand and partially contract or wrap around one of the braces. When the constant force springs expand to their expanded condition, the dunnage is move downwardly, thereby causing the previously collapsed cells or compartments to open above the compartments already filled with product. With the dunnage now more fully expanded, additional parts or product may be inserted into the newly exposed compartments in the same ergonomically friendly area or zone in which the user had earlier loaded parts or products. Thus, the user need not "pear dive" or bend over to insert parts into the open dunnage compartments. The filled compartments move downwardly out of the ergonomically friendly loading zone.

To unload a horizontal dispensing container filled with parts or product located in the dunnage compartments, the user removes parts or products in the ergonomically friendly zone or area. The user need not bend over to attempt to remove parts or products from compartments therebelow.

When the combined weight of the parts or products remaining in the compartments exceeds a predetermined value, the constant force springs partially collapse or wrap more around the braces due to the lack of force being exerted on them by the product or parts. The force being exerted on the constant force springs is less than a threshhold value required to keep the constant force springs expanded. When the constant force springs partially collapse to their collapsed condition, the dunnage raises or moves upwardly, thereby collapsing or closing previously open or exposed cells or compartments above the compartments therebelow still filled with product. With the dunnage now partially collapsed, additional parts or product may be removed from the compartments in the same ergonomically friendly area or zone in which the user had earlier unloaded products from the compartments now collapsed.

One advantage of the present invention is that product may be either inserted or removed from dunnage inside a horizontal dispensing container in an ergonomically friendly area or zone which does not strain the user's back or legs.

Another advantage of the present invention is that the dunnage may be partially collapsed during shipment inside a horizontal dispensing container.

BRIEF DESCRIPTION OF THE DRAWINGS

The objectives and features of the present invention will become more readily apparent when the following detailed description of the drawings is taken in conjunction with the accompanying drawings in which.

DETAILED DESCRIPTION OF THE DRAWINGS

Figure 1:
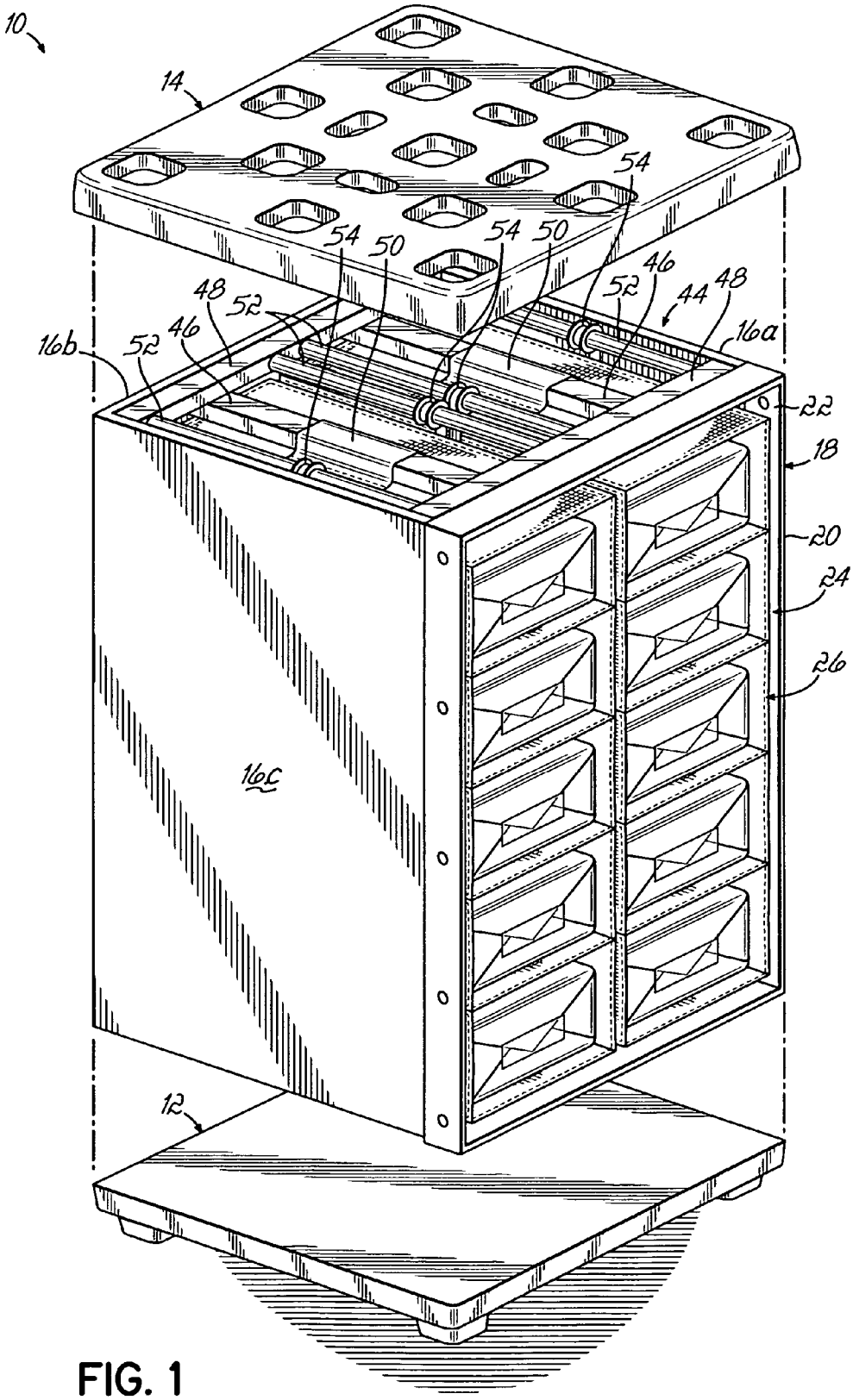
FIG. 1 is a partially disassembled perspective view of a horizontal dispensing container with one preferred embodiment of dunnage system of the present invention therein.

Referring to FIG. 1, there is illustrated a horizontal dispensing container 10 according to one embodiment of the present invention. The horizontal dispensing container 10 comprises comprising an injection molded base 12, a removable cover 14, three vertically oriented walls 16*a*, 16*b*, and 16*c*, and a generally rectangular frame 18 on a fourth side of the container 10 which is secured to two of the walls 16*a* and 16*c*. The generally rectangular frame 18 defines a fourth wall 20 having an opening 22 therein for access to the interior 24 of the horizontal dispensing container 10. The cover 14 is removably secured on top of the container walls 16*a*, 16*b* and 16*c* and generally rectangular frame 18. This container is fully disclosed in U.S. patent application Ser. No. 10/761,013 which is fully incorporated herein. Although one type of horizontal dispensing container 10 is illustrated and described, the present invention may be used in any type of horizontal dispensing container including a horizontal dispensing container which is accessible from opposite sides.

Figure 3A:
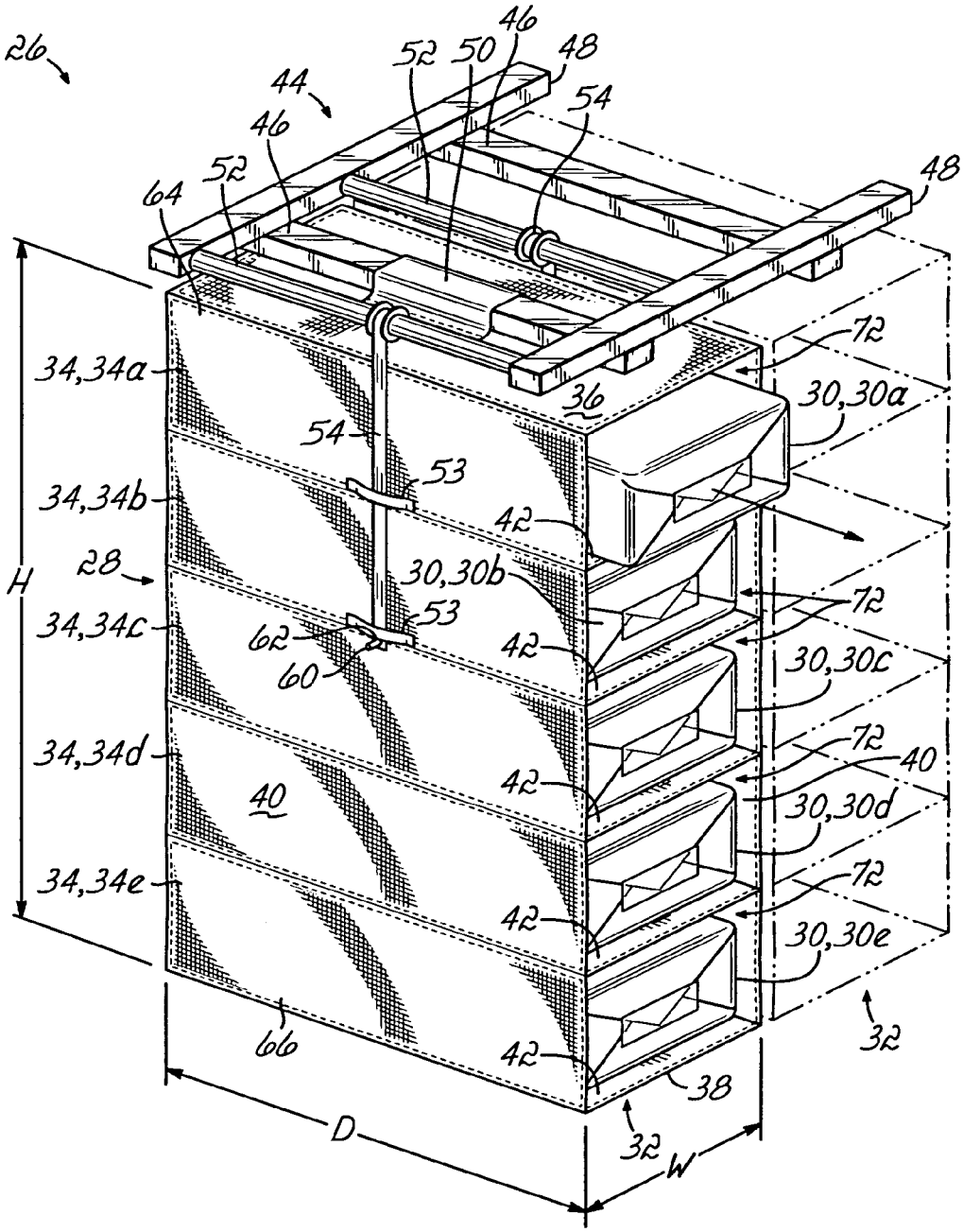
FIG. 3A is a perspective view of the dunnage system of FIG. 1 in an expanded position and fully loaded.

As shown in FIG. 3A, the invention comprises a dunnage system 26 including dunnage 28 which is partially collapsible and partially expandable to ensure that a worker removing and/or inserting products from the horizontal dispensing container 10 does not unnecessarily strain his or her back and/or other muscles or joints. The present invention vertically moves the dunnage to an ergonomically friendly zone or area for loading or unloading product depending upon a number of factors explained below.

The partially collapsible, partially expandable dunnage 28 is formed of a flexible material such as known plastics, i.e. polyethylene, polypropylene or polyester, for example. The dunnage 28 is used for storing and/or transporting products 30. Although one configuration of product 30 is illustrated, the dunnage 28 may be used to store or transport any other configuration or type of product. Depending upon the type and number of product to be transported in the dunnage, the dunnage may assume numerous shapes or configurations. The present invention is not intended to be limited to the preferred embodiments illustrated and described below.

The dunnage 28 illustrated in FIGS. 3A-3E and 4A-4E comprises two columns 32 (one shown in phantom) of compartments or cells 34, each column 32 being independently partially collapsible and partially expandable. Each column 32 has a height H, a width W and a depth D. Although two columns 32 are illustrated, the dunnage 28 of the present invention may include any number of independently adjustable columns 32 of dunnage. For purposes of simplicity the operation of only one column 32 will be illustrated and described.

Each column 32 of dunnage 28 has five compartments 34*a*, 34*b*, 34*c*, 34*d* and 34*e*, each compartment having an opening 72 through which product 30 may be inserted or removed. Each column 32 of dunnage 28 has an upper or top wall 36, a bottom or lower wall 38 and a pair of sidewalls 40. Internal walls 42 extending between the sidewalls 40 define each of the compartments 34*a*, 34*b*, 34*c*, 34*d* and 34*e*. Although five compartments are illustrated per column 32, each column 32 may have any number of compartments without departing from the spirit of the invention.

The dunnage system 26 further comprises a support 44 for supporting the dunnage 28 inside the interior 24 of the horizontal dispensing container 10. The support 44 is preferably secured inside the horizontal dispensing container 10 proximate the top of the container 10. However, the support 44 may be located at any desired location in the horizontal dispensing container 10 and secured in place in any desired manner.

As shown In FIGS. 3A-3E and 4A-4E, each column 32 of compartments 34 is independently supported by the support 44. The support 44 includes at least one support bar 46 extending between and secured to two cross support bars 48. More particularly, each support bar 46 extends through a support pouch 50 integrally formed in the column 32 of compartments 34. Other methods and/or structures for supporting the columns 32 of dunnage 28 such as multiple rods (not shown) extending between opposite walls of the container may be used in accordance with the present invention.

Figure 2:
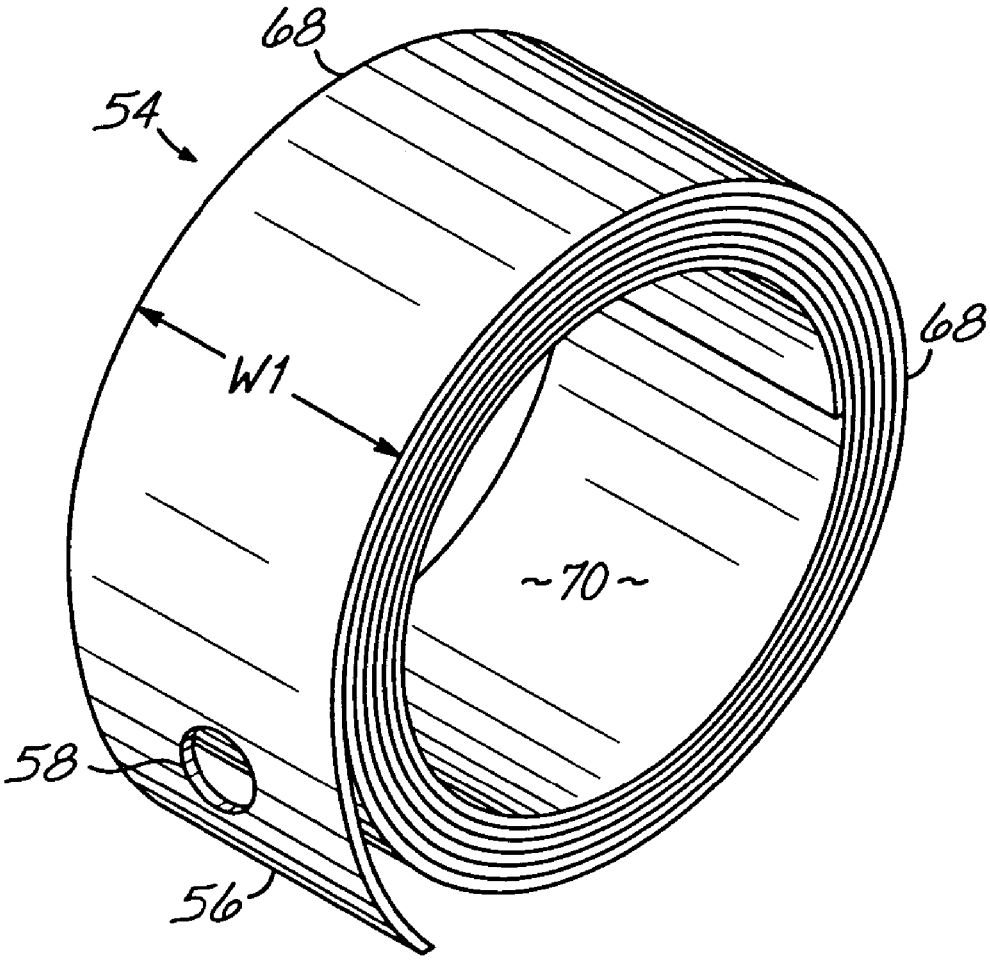
FIG. 2 is a perspective view of one of the constant force springs of the dunnage system of FIG. 1.

The dunnage system 26 further comprises braces 52 in the form of cylindrical rods extending between the cross support bars 38 for supporting constant force springs 54, one of which is shown in detail in FIG. 2. Although one configuration of brace 52 is illustrated, other configurations or designs of braces 52 may be used in accordance with the present invention.

In the embodiment shown In FIGS. 3A-3E and 4A-4E, each column 32 of compartments 34 has a pair of constant force springs 54 acting thereon to partially collapse and/or partially expand the column 32 of dunnage 28. Each of the constant force springs 54 is partially wrapped around one of the braces 52 as shown in FIG. 3A. However, any number of constant force springs 54 may be used to partially expand and/or partially contract the dunnage 28 in accordance with the present invention.

As seen in FIG. 2, a first end 56 of each constant force spring 54 has a hole 58 therethrough for securing the first end 56 of the constant force spring 54 to a sidewall 40 of a column 32 of dunnage 28 as shown in FIG. 3A. A fastener such as a screw or rivet 60 is passed through the hole 58 in the constant force spring 54 and the sidewall 40 of the column 32 of dunnage 28 to secure the first end 56 of the constant force spring 54 to the column 32 of dunnage 28 at an attachment point 62. See FIG. 3A. However, any other method or device for securing the constant force springs 54 to the dunnage 28 may be used.

As seen in FIG. 3A, the attachment point 62 is located between an outside upper edge 64 and the outside lower edge 66 of a column 32 of dunnage 28. In the preferred embodiment shown in the drawings, the attachment point 62 is located between the second and third compartments 34*b*, 34*c*. However, depending upon the desired application, the attachment points 62 may be at other desired locations. As shown in FIG. 3A, holders 53 secured to the sidewall 40 of the column 32 help hold each of the constant force springs 54 along the sidewall 40 of the column 32. Any number of holders 53 may be used, depending upon the desired application.

As shown in FIG. 2, each constant force spring 54 is a non-coil spring and has a uniform width W1 defined as the linear distance between the outer edges 68 of the constant force spring 54. The inherent tendency of the constant force spring 54 is to wrap in the manner shown in FIG. 2 to define an interior passage 70 through which one of the braces 52 passes. See FIG. 3A. As shown in FIG. 3A, each of the constant force springs 54 has a predetermined length (if fully expanded) much greater than the linear distance between the brace 52 around which the constant force spring 54 is wrapped and the attachment point 62. Consequently, the degree to which the constant force spring 54 is expanded is limited by the height H of the column 32 of dunnage 28 and the location of the attachment point 62. In the preferred embodiments of the present invention, the constant force spring 54 is never fully expanded, a portion of it is always wrapped around one of the braces 52. However, if desired, the other end of the constant force spring 54 may be permanently secured to the brace 52, in which case the constant force spring 54 could fully expand.

FIGS. 3A-3E illustrate the method of unloading products 30 from a loaded dunnage column 32. For purposes of simplicity, the horizontal dispensing container 10 is omitted from FIGS. 3A-3E. FIG. 3A illustrates a column 32 of dunnage 28, each of the compartments 34*a*, 34*b*, 34*c*, 34*d* and 34*e* being loaded or filled with a product 30. If desired, multiple products 30 may be located in one or more of the compartments 34.

For purposes of example only, each of the products 30 has a weight of 2 pounds. As shown in FIG. 3A, because there are five compartments 34*a*, 34*b*, 34*c*, 34*d* and 34*e*, each filled with one product 30 weighing two pounds, the combined weight of a fully filled or loaded column 32 is 10 pounds. For purposes of example only, each of the constant force springs 34 has 2.5 pound force necessary to partially extend the constant force spring 34. Because two constant force springs 34 are secured to the sidewalls 40 of a column 32 of dunnage 28, the combined force necessary to partially expand the constant force springs 34 and consequently partially expand the column 32 of dunnage 28 is five pounds.

Due to the combined weight of the products 30 in the compartments 32 (ten pounds) exceeding the five pound threshold force required to partially extend the two constant force springs 34 secured to the column 32 of dunnage 28, the column 32 of dunnage 28 is fully expanded in FIG. 3A. Both of the constant force springs 34 are therefore, partially expanded with a portion of each constant force spring 54 still being wrapped around one of the braces 52.

FIG. 3A illustrates a first product 30*a* being removed from the uppermost or top compartment 34*a* through an opening 72 in the compartment 34*a*. After product 30*a* has been removed, the combined weight of the four products 30*b*, 30*c*, 30*d* and 30*e* remaining in the column 32 is 8 pounds. Because the combined weight of the remaining products 30*b*, 30*c*, 30*d* and 30*e* (eight pounds) in the compartments 32*b*, 32*c*, 32*d* and 32*e* exceeds the five pound threshold force required to partially extend the two constant force springs 34 secured to the column 32 of dunnage 28, the column 32 of dunnage 28 is fully expanded in FIG. 3A. Both of the constant force springs 34 are therefore, partially expanded with a portion of each constant force spring 54 still being wrapped around one of the braces 52.

Figure 3B:
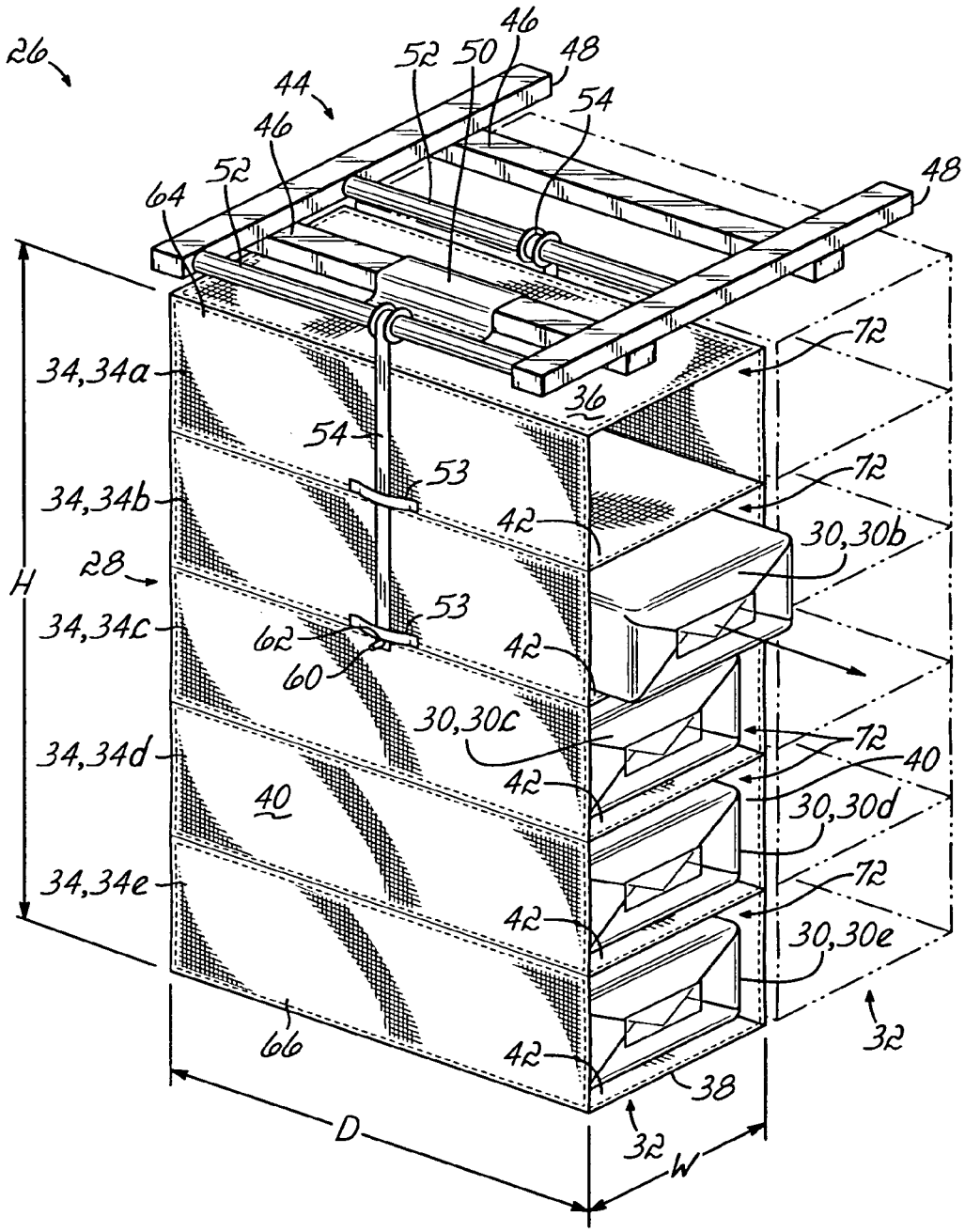
FIG. 3B is a perspective view of the dunnage system of FIG. 3A in an expanded position showing a second part being removed.

FIG. 3B illustrates another two pound product 30*b* being removed from compartment 34*b* through an opening 72 in the compartment 34*b*. After product 30*b* has been removed, the combined weight of product remaining in the column 32 of dunnage 28 is six pounds, two pounds each for products 30*c*, 30*d* and 30*e*. Because the combined weight of the remaining products 30*c*, 30*d* and 30*e* (six pounds) in the compartments 32*b*, 32*c*, 32*d* and 32*e* exceeds the five pound threshold force required to partially extend the two constant force springs 34 secured to the column 32 of dunnage 28, the column 32 of dunnage 28 is fully expanded in FIG. 3B. Both of the constant force springs 34 are therefore, partially expanded with a portion of each constant force spring 54 still being wrapped around one of the braces 52.

Figure 3C:
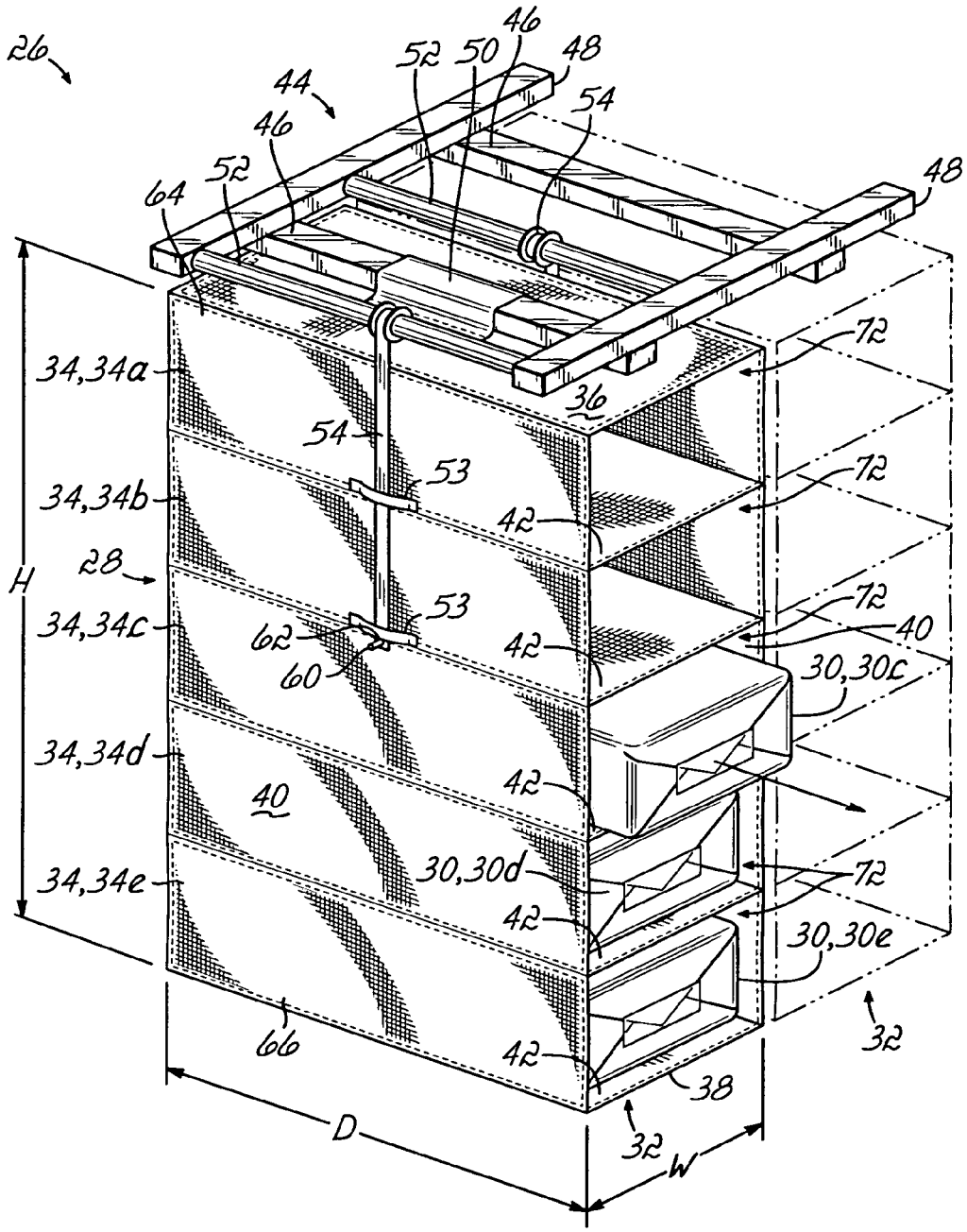
FIG. 3C is a perspective view of the dunnage system of FIG. 3A in an expanded position showing a third part being removed.

FIG. 3C illustrates another two pound product 30*c* being removed from compartment 34*c* through an opening 72 in the compartment 34*c*. After product 30*c* has been removed, the combined weight of product remaining in the column 32 of dunnage 28 is four pounds, two pounds each for products 30*d* and 30*e*.

Figure 3D:
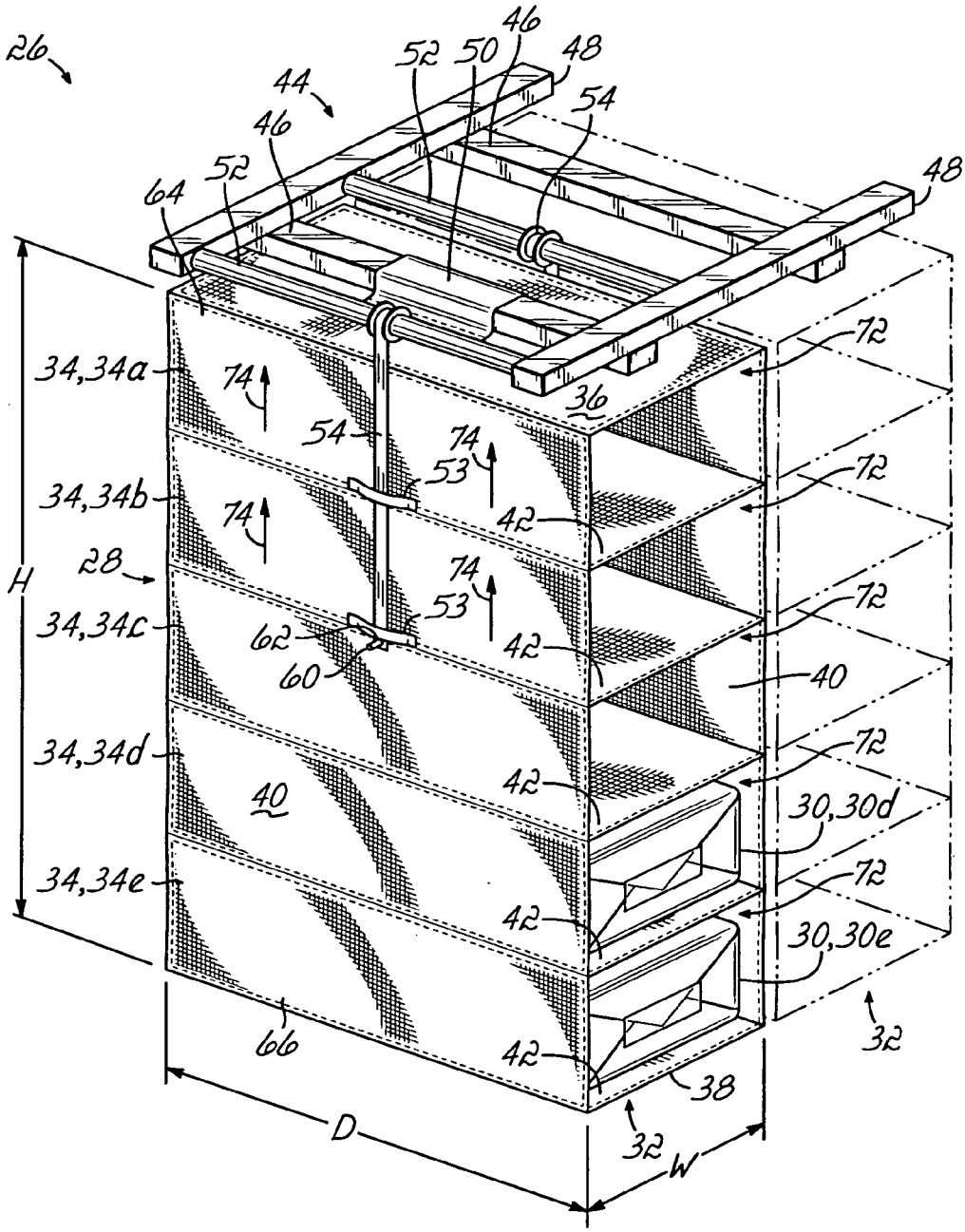
FIG. 3D is a perspective view of the dunnage system of FIG. 1 in an expanded position partially collapsing after a third part is removed.

FIG. 3D illustrates the column 32 of dunnage 28 partially collapsing upwardly in the direction of arrows 74 because the combined weight of the remaining products 30*d* and 30*e* (four pounds) in the compartments 32*d* and 32*e* is less than the five pound threshold force required to partially extend the two constant force springs 34 secured to the column 32 of dunnage 28. During this process of partial collapsing of the column 32 of dunnage 28 shown in FIGS. 3D and 3E, each of the constant force springs 34 lifts or acts on the column 32 and further wraps around one of the braces 52.

Figure 3E:
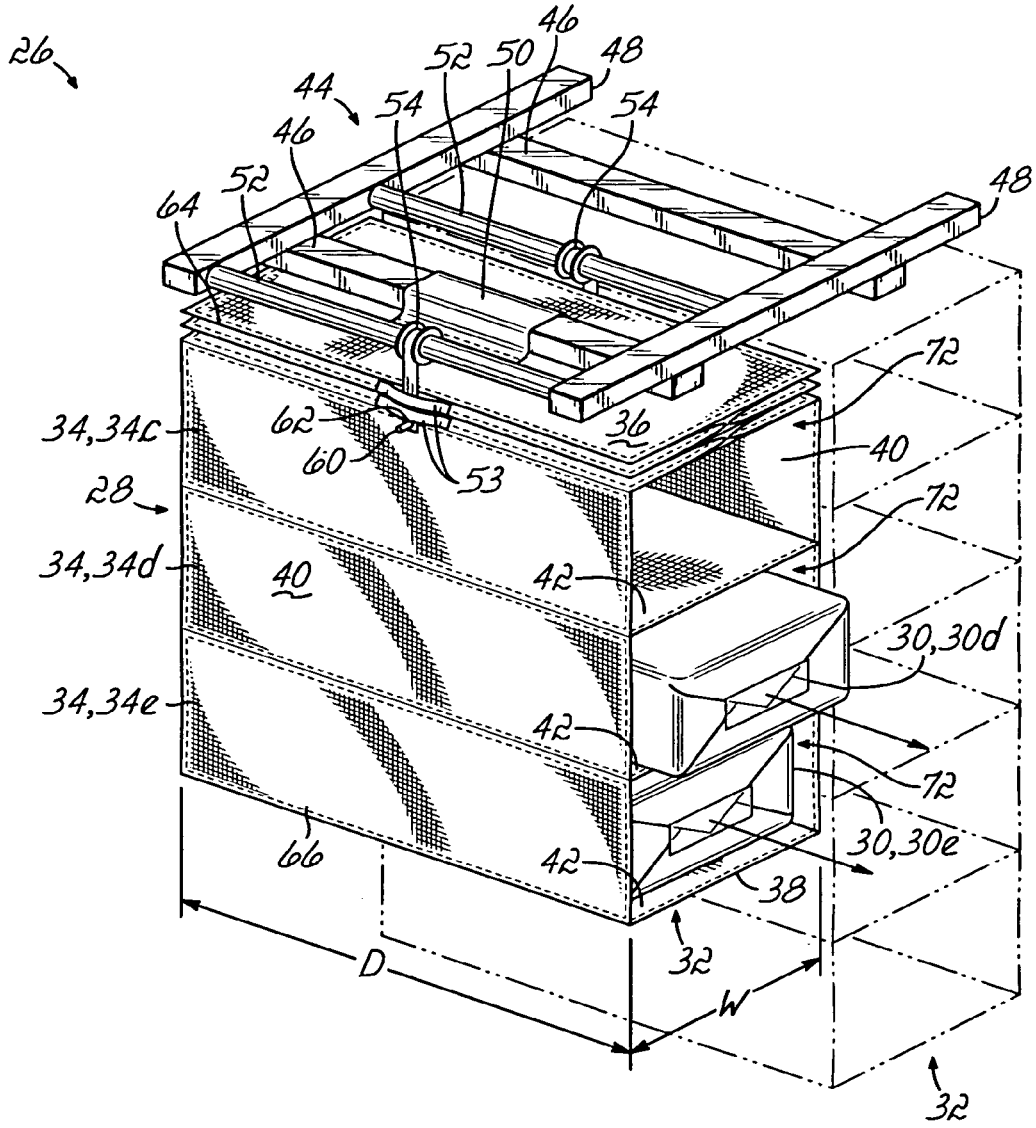
FIG. 3E is a perspective view of the dunnage system of FIG. 1 in a partially collapsed position showing the remaining parts being removed.

As shown in FIG. 3E, due to the further wrapping of the constant force springs 54 around braces 52, the compartments 34*a* and 34*b* located above the attachment points 62 (where the ends 56 of the constant force springs 54 are secured to the sidewalls 40 of the column 32 of dunnage 28) collapse so they are no longer accessible. Compartments 34*d*, 34*d* and 34*e* located below the attachment points 62 do not collapse but are raised upward into an ergonomically friendly area or zone. This ergonomically friendly zone is typically between the waist and shoulders of a worker but is not restricted to any defined zone or area. Because product 30*c* has already been removed from compartment 34*c*, compartment 34*c* is empty when the column 32 of dunnage 28 is collapsed as much as it will collapse due to the location of the attachment points 62. FIG. 3E illustrates products 30*d* and 30*e* being removed from compartments 34*d* and 34*e*. Even when products 30*d* and 30*e* are removed and all of the compartments 34*a*-34*e* are empty, the column 32 of dunnage 28 will not further collapse due to the location of the attachment points 62 of the constant force springs 54 to the dunnage sidewalls 40.

The degree to which any column 32 of dunnage 28 of the present invention may be collapsed or expanded depends upon the number of compartments 34 within the column 32 and the location of the attachment points 62 of the constant force springs 54 to the dunnage sidewalls 40.

Figure 4A:
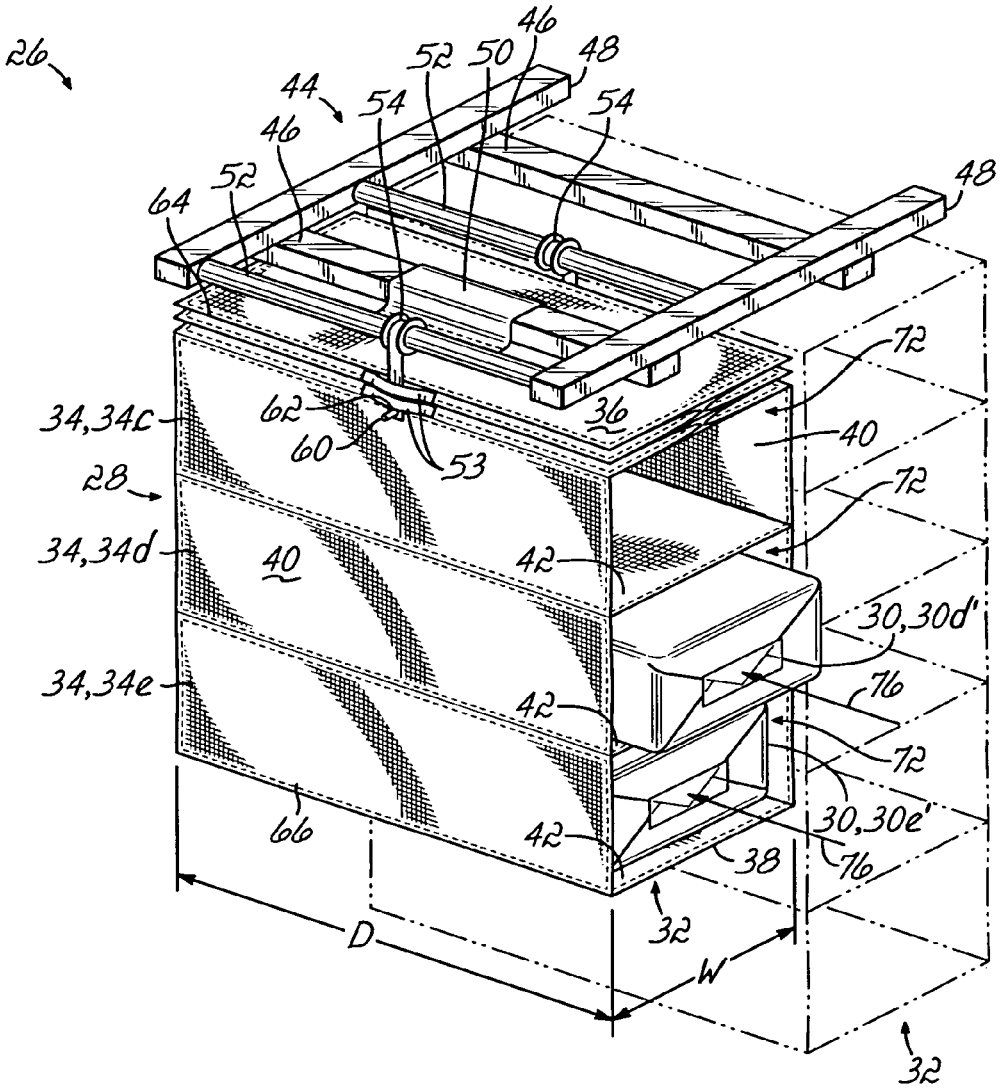
FIG. 4A is a perspective view of the dunnage system shown in FIG. 1 in a partially collapsed position showing two parts being inserted therein.

FIGS. 4A-4E illustrate the method of loading products 30 into an empty, partially collapsed column 32 of dunnage 28. For purposes of simplicity, the horizontal dispensing container 10 is omitted from FIGS. 4A-4E. FIG. 4A illustrates a column 32 of dunnage 28 in a partially collapsed condition, each of the compartments 34*a*, 34*b*, 34*c*, 34*d* and 34*e* being empty and compartments 30*a* and 30*b* being collapsed. If desired, multiple products 30 may be loaded into any one or more of the compartments 34.

FIG. 4A illustrates products 30*d*' and 30*e*' being inserted into the two lowermost or bottom compartments 34*d*, 34*e* through openings 72 in the compartments 34*d*, 34*e*. See arrows 76. The compartment 34*c* remains empty. After products 30*d*' and 30*e*' have been inserted, the combined weight of the two products 30*d*' and 30*e*' in the column 32 is four pounds, two pounds each. Because the combined weight of these two products 30*d*' and 30*e*' (four pounds) in the compartments 34*d* and 34*e* is less than the five pound threshold force required to partially extend the two constant force springs 34 secured to the column 32 of dunnage 28, the column 32 of dunnage 28 remains partially collapsed as shown in FIG. 4A. Both of the constant force springs 34 are therefore, partially collapsed with a portion of each constant force spring 54 wrapped around one of the braces 52.

Figure 4B:
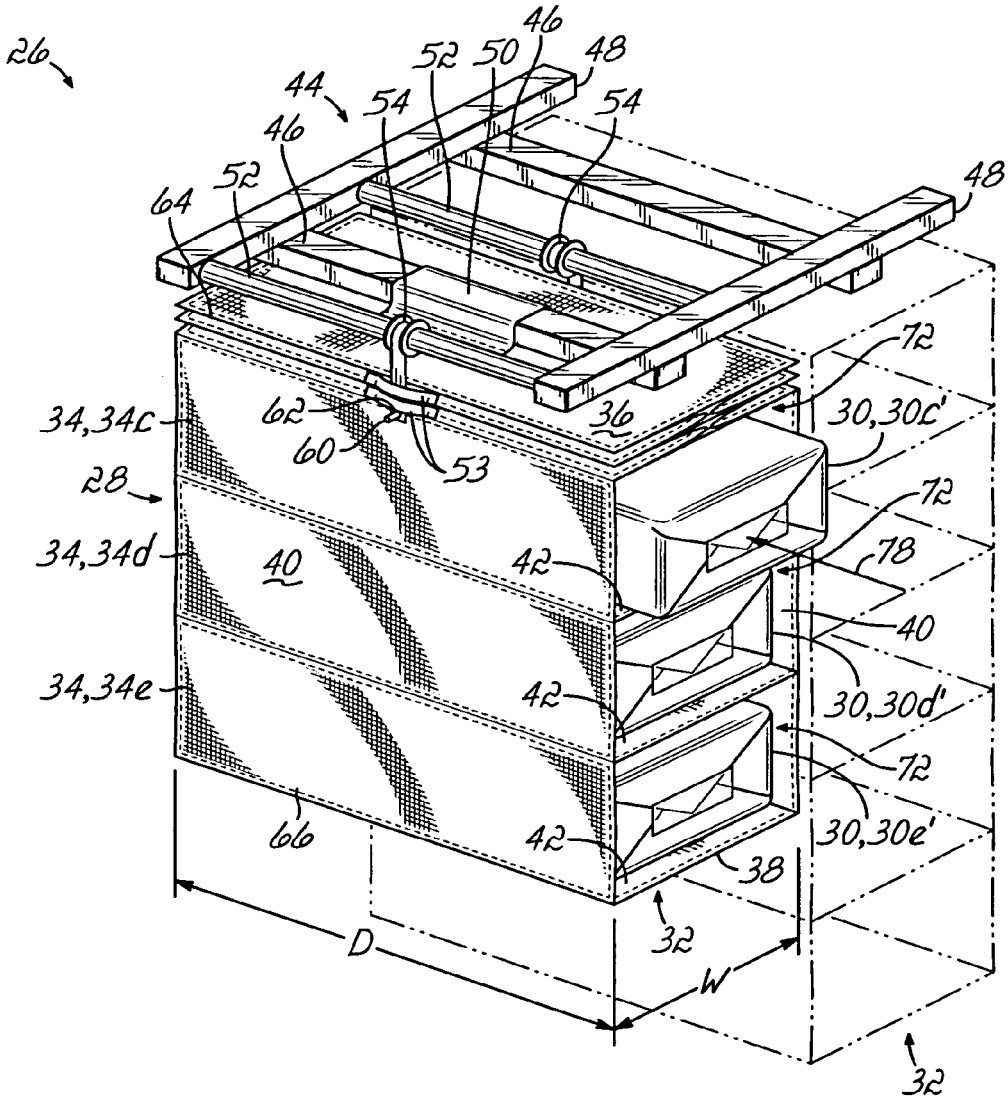
FIG. 4B is a perspective view of the dunnage system of FIG. 1 in a partially collapsed position showing a third part being inserted into a third compartment of the dunnage system.

FIG. 4B illustrates another two pound product 30*c*' being inserted into compartment 34*c* through an opening 72 in the compartment 34*c* in the direction of arrow 78. After product 30*c*' has been inserted, the combined weight of products in the column 32 of dunnage 28 is six pounds, two pounds each for products 30*c*', 30*d*' and 30*e*'. Because the combined weight of the products 30*c*', 30*d*' and 30*e*' (six pounds) in the compartments 32*c*, 32*d* and 32*e* exceeds the five pound threshold force required to partially extend the two constant force springs 34 secured to the column 32 of dunnage 28, both of the constant force springs 34 partially expand with a portion of each constant force spring 54 still being wrapped around one of the braces 52. See FIG. 4C.

Figure 4C:
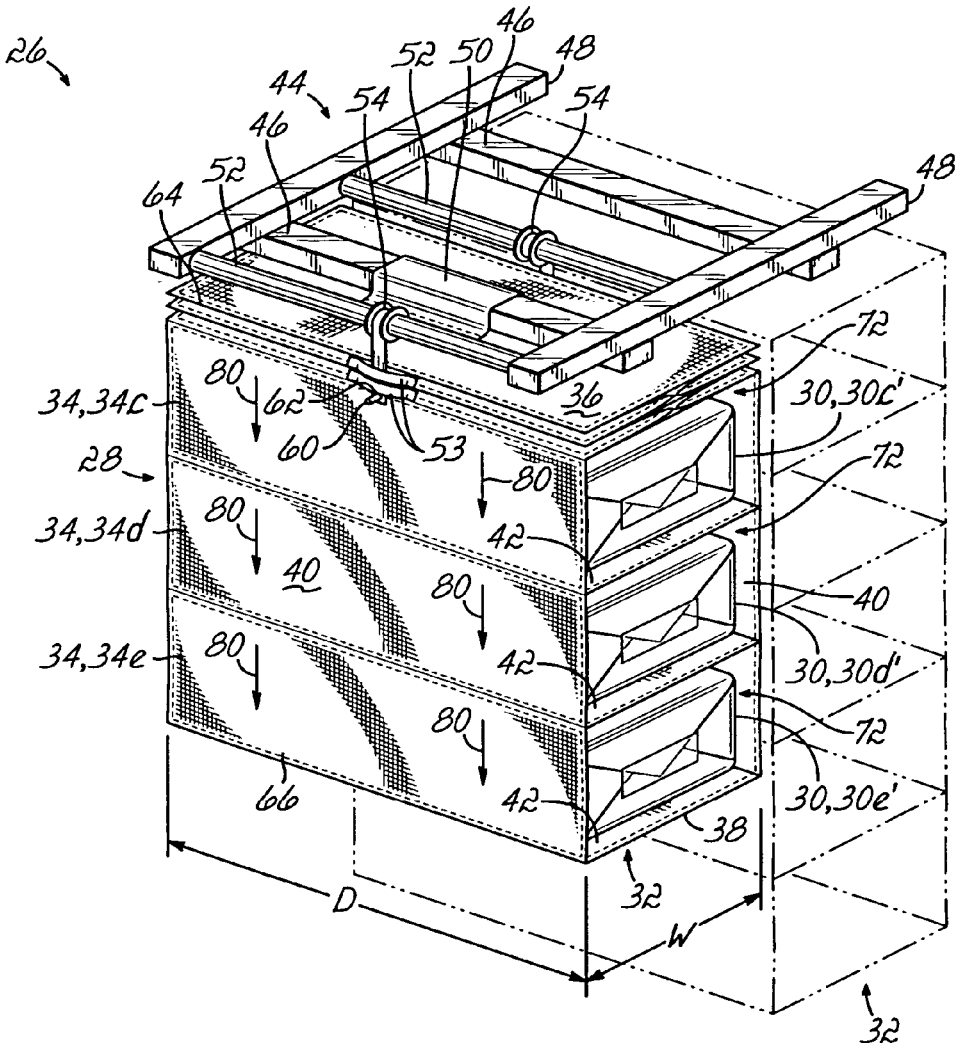
FIG. 4C is a perspective view of the dunnage system of FIG. 1 expanding after the third part is inserted into the third compartment.

FIG. 4C illustrates the column 32 of dunnage 28 partially expanding downwardly in the direction of arrows 80 thereby causing compartments 34*e* and 34*d* to drop downwardly and compartments 34*a* and 34*b* to expand or open. During this process of partial expanding of the column 32 of dunnage 28 shown in FIGS. 4C and 4D, each of the constant force springs 34 acting on the column 32 unwraps to a certain extent from around one of the braces 52.

Figure 4D:
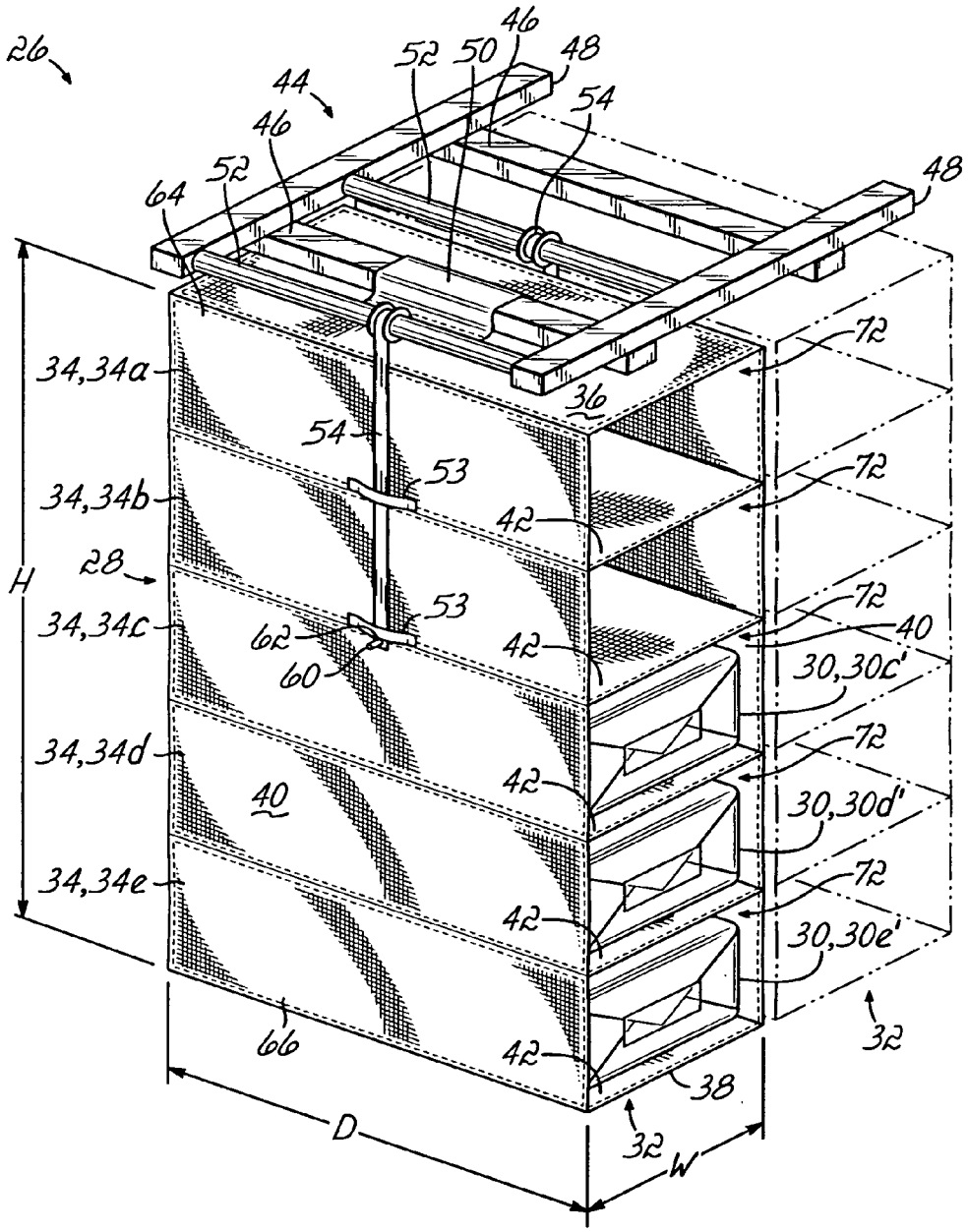
FIG. 4D is a perspective view of the dunnage system of FIG. 1 in an expanded position, the top two compartments being empty.

FIG. 4D illustrates the column 32 of dunnage 28 in a partially expanded condition because the combined weight of the products 30*c*', 30*d*' and 30*e*' in the compartments 34*c*, 34*d* and 34*e* (six pounds) exceeds the five pound threshold force required to partially extend the two constant force springs 34 secured to the column 32 of dunnage 28. The extent to which the constant force springs 34 are extended is limited by the height H of the column 32 of dunnage 28 along with the location of the attachment points 62 of the constant force springs 34 to the dunnage 28. See FIG. 4D. When the column 32 of dunnage 28 is expanded as shown in FIG. 4D, compartments 34*a* and 34*b* are no longer collapsed but instead open or accessible for parts to be inserted therein. Both of the constant force springs 34 are partially expanded with a portion of each constant force spring 54 still being wrapped around one of the braces 52.

Figure 4E:
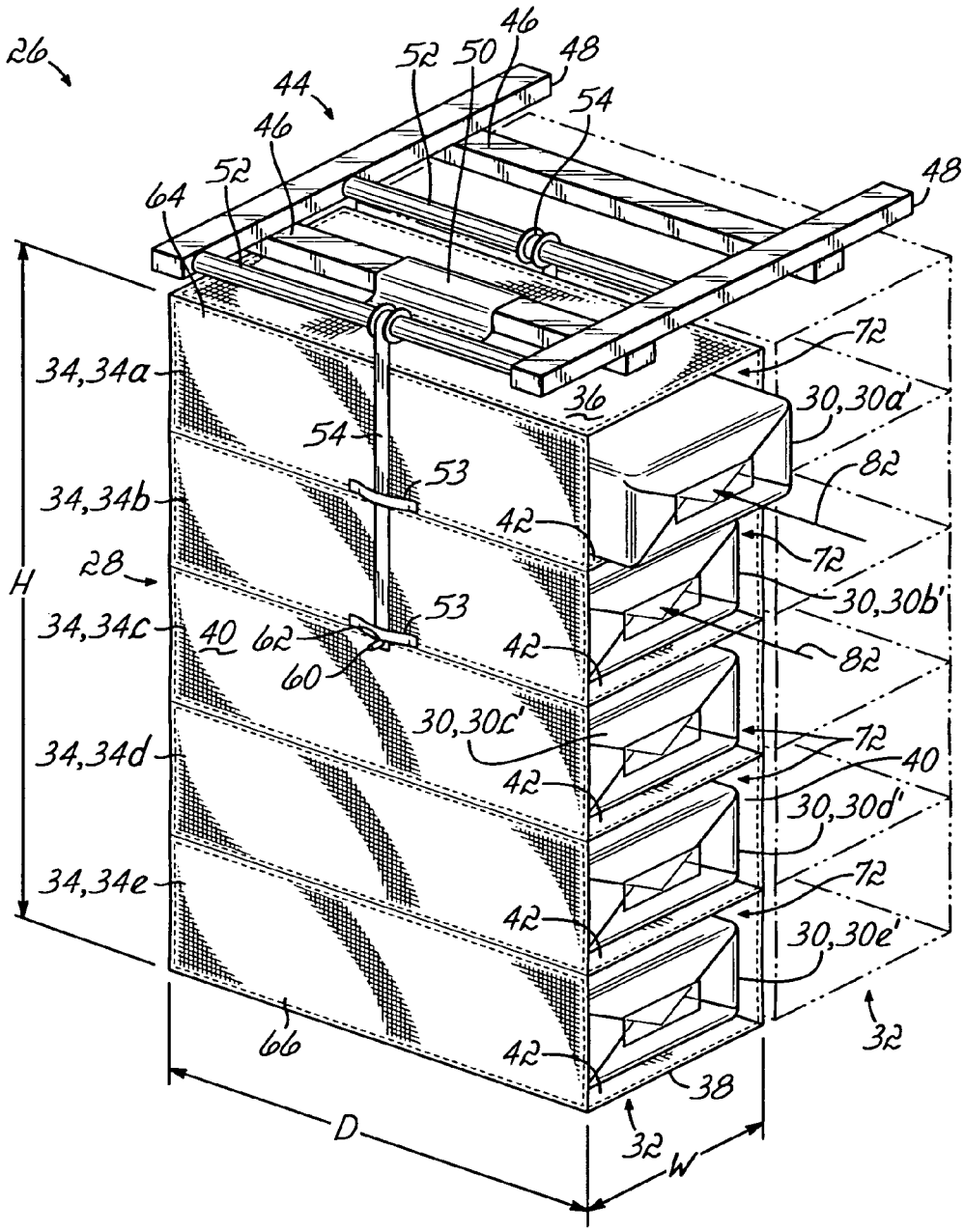
FIG. 4E is a perspective view of the dunnage system of FIG. 1 in an expanded position showing the remaining compartments being filled.

FIG. 4E illustrates two additional products 30*a*' and 30*b*' being inserted into newly opened or exposed compartments 34*a* and 34*b* through openings 72 in the direction of arrows 82. These additional products 30*a*' and 30*b*' are loaded in the ergonomically friendly area or zone in which products may be easily loaded.

Figure 5:
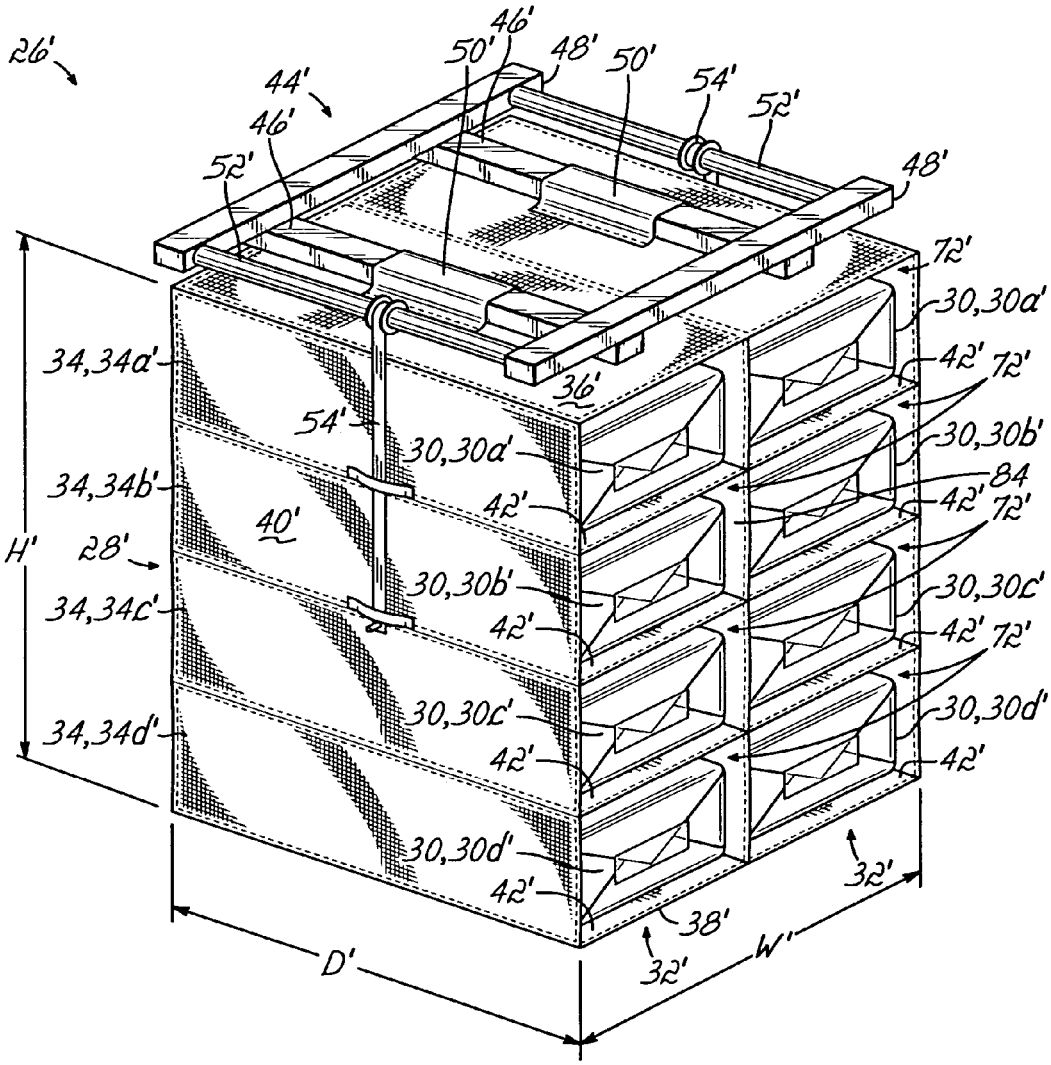
FIG. 5 is a perspective view an alternative embodiment of dunnage system in accordance with the present invention in an expanded position.

An alternative preferred embodiment of the present invention is illustrated in FIG. 5. In this preferred embodiment, the partially collapsible, partially expandable dunnage system 26' comprises dunnage 28' used for storing and/or transporting products 30 as described above. The dunnage 28' comprises two columns 32' of integrally connected compartments or cells 34 separated by an internal divider 84. In this preferred embodiment, each column 32' is not independently partially collapsible and partially expandable. However, the dunnage 28' as a whole is partially collapsible and partially expandable. The dunnage 28' has a height H', a width W' and a depth D'. Although two adjoining connected columns 32' are illustrated, the dunnage 28' of the present invention may include any number of integrally connected columns 32' of dunnage.

Each column 32' of dunnage 28' has four compartments 34*a*', 34*b*', 34*c*', and 34*d*', each compartment having an opening 72' through which product 30 may be inserted or removed. The dunnage 28' has an upper or top wall 36', a bottom or lower wall 38' and a pair of outer sidewalls 40'. Internal horizontal walls 42' extending between the outer sidewalls 40' along with internal vertical divider 84 define eight compartments, compartments 34*a*'-34*d*' being in one column 32' and compartments 34*e*'-34*h*' being in another column 32'. Although four compartments are illustrated per column 32', each column 32' may have any number of compartments without departing from the spirit of the invention.

The dunnage system 26' further comprises a support 44' for supporting the dunnage 28' inside a horizontal dispensing container (not shown). The support 44' is preferably secured inside the horizontal dispensing container (not shown) proximate the top of the container. However, the support 44' may be located at any desired location in the horizontal dispensing container and in any desired manner.

As shown in FIG. 5, each column 32' of compartments 34' is independently supported by a portion of the support 44'. The support 44' includes a support bar 46' extending between and secured to two cross support bars 48'. More particularly, each support bar 46' extends through a support pouch 50' integrally formed in the column 32' of compartments 34'. Other methods and/or structures for supporting the columns 32' of dunnage 28' such as multiple rods (not shown) extending between opposite walls of the container may be used in accordance with the present invention.

The dunnage system 26' further comprises braces 52' in the form of cylindrical rods extending between the cross support bars 38' for supporting constant force springs 54', one of which is shown in detail in FIG. 2. Although one configuration of brace 52' is illustrated, other configurations or designs of braces 52' may be used in accordance with the present invention.

In the embodiment illustrated in FIG. 5, the dunnage 28' has a pair of constant force springs 54' acting thereon to partially collapse and/or partially expand the dunnage 28'. Each of the constant force springs 54' is partially wrapped around one of the braces 52' as shown in FIG. 5 and secured to one of the sidewalls 40' at attachment points 62'.

While we have described several preferred embodiments of the present invention, persons skilled in the art will appreciate changes and modifications which may be made without departing from the spirit of the invention. For example, although one configuration of dunnage is illustrated and described, the present invention may be used with other configurations of dunnage. Therefore, we intend to be limited only by the scope of the following claims and equivalents thereof:

We claim:

1. A dunnage system for use in a horizontal dispensing container, said dunnage system comprising:

dunnage having a plurality of compartments;

support for said dunnage;

braces extending between opposed sides of a horizontal dispensing container; and a plurality of constant force springs, each of said constant force springs being at least partially wrapped around a brace and secured at one end to the dunnage, wherein said compartments are arranged in at least one vertically oriented column.

2. The dunnage system of claim 1 wherein each of said constant force springs is a non-helical spring.

3. The dunnage system of claim 1 wherein the support for said dunnage is proximate a top of the horizontal dispensing container.

4. The dunnage system of claim 1 wherein the dunnage comprises two columns of compartments.

5. The dunnage system of claim 1 wherein the support for the dunnage is integral with a cover to said container.

6. The dunnage system of claim 1 wherein the braces are integral with a cover to said container.

7. The dunnage system of claim 1 wherein the constant force springs are selected so that when the combined weight of the products in the compartments at or below the locations at which the constant force springs are secured to the dunnage exceeds a threshold amount the constant force springs are extended.

8. A dunnage system for use in a horizontal dispensing container, said dunnage system comprising:

dunnage having a plurality of compartments;

support for said dunnage;

braces extending between opposed sides of a horizontal dispensing container; and a plurality of constant force springs, each of said constant force springs being secured at one end to said dunnage and partially wrapped around one of said braces, wherein each of said constant force springs is movable between a partially extended position and a partially collapsed position, wherein said constant force springs are secured at intermediate locations between top and bottom outer edges of said dunnage.

9. The dunnage system of claim 8 wherein said constant force springs move between said positions depending upon the combined weight of the products in the compartments at or below the locations at which the constant force springs are secured to the dunnage.

10. The dunnage system of claim 8 wherein the dunnage comprises multiple columns of compartments.

11. The dunnage system of claim 8 wherein the dunnage is formed from a flexible material.

12. The dunnage system of claim 8 wherein the constant force springs partially collapse when the combined weight of products in the compartments at or below said intermediate locations is less than a predetermined weight.

13. The dunnage system of claim 8 wherein some of the compartments of the dunnage are not accessible when the constant force springs are partially collapsed.

14. A method of loading products into dunnage comprising a column of compartments formed from a flexible material, said dunnage being secured in a horizontal dispensing container, said method comprising:

inserting product into a column of compartments of said dunnage until the combined weight of said products loaded into said compartments exceeds a predetermined value such that a plurality of constant force springs expand to an expanded condition, each of said constant force springs being wrapped around a brace and secured at one end to an intermediate point of said dunnage.

15. The method of claim 14 further comprising inserting additional products into compartments previously collapsed.

16. A method of loading products into dunnage comprising a column of compartments formed from a flexible material, said dunnage being supported by supports in a horizontal dispensing container, said method comprising:

inserting products into compartments of said dunnage in an ergonomically friendly zone until the combined weight of said products loaded into said compartments exceeds a predetermined value, said combined weight of said products causing constant force springs extending between braces and said dunnage to expand to an expanded condition; and inserting additional products into compartments previously collapsed.

17. A method of unloading products into dunnage comprising a column of compartments formed from a flexible material in a horizontal dispensing container, said method comprising:

removing products from compartments of said dunnage until the combined weight of said products remaining in said compartments is less than a predetermined value, thereby causing the dunnage to partially collapse due to constant force springs, each of said constant force springs being wrapped around a brace at the top of said horizontal dispensing container and secured at one end to an intermediate point of said dunnage.

18. The method of claim 17 further comprising removing additional products from compartments below the collapsed compartments of the dunnage.

19. A method of unloading products into dunnage comprising a column of compartments formed from a flexible material in a horizontal dispensing container, said method comprising:

removing products from some of said compartments of said dunnage in an ergonomically friendly zone until the combined weight of said products remaining in said compartments is less than a predetermined value, thereby causing the dunnage to partially collapse; and removing additional products from additional compartments in said ergonomically friendly zone.

20. A method of loading products into dunnage comprising a column of compartments formed from a flexible material, said dunnage being secured in a horizontal dispensing container, said method comprising:

Inserting product into a column of compartments of said dunnage until the combined weight of said products loaded into said compartments exceeds a predetermined value such that a plurality of constant force springs expand to an expanded condition, each of said constant force springs being secured to a brace at one end and secured to said dunnage at its other end.

21. A horizontal dispensing container comprising:

a base;

three vertically oriented walls;

a generally rectangular frame on a fourth side of the container, said frame having an opening therein for access to an interior of the container;

partially collapsible and partially expandable dunnage comprising a plurality of compartments arranged in at least one vertically oriented column;

a plurality of constant force springs, each of said constant force springs being secured at one end to the dunnage: and support for said dunnage.

22. The container of claim 21 further comprising a removable cover.

23. A horizontal dispensing container comprising:

a base;

walls on three sides of the container;

a generally rectangular frame on a fourth side of the container, said frame having an opening therein for access to an interior of the container;

dunnage comprising a plurality of compartments arranged in vertically oriented columns wherein each of said columns is partially collapsible and partially expandable;

springs for partially collapsing and partially expanding each of said columns of dunnage: and support for said dunnage.

* * * * *

UNITED STATES PATENT AND TRADEMARK OFFICE

CERTIFICATE OF CORRECTION

PATENT NO. : 7,258,232 B2
APPLICATION NO. : 10/965053
DATED : August 21, 2007
INVENTOR(S) : Judson A. Bradford et al.

It is certified that error appears in the above-identified patent and that said Letters Patent is hereby corrected as shown below:

Column 2

Line 24, “may designed” should be --may be designed--.

Line 40, “incorporate” should be --incorporated--.

Line 57, change “with departing” to --without departing--.

Column 3

Line 30, “spring are” should be --springs are--.

Line 46, “pear drive” should be --pearl drive--.

Line 55, “may utilized” should be --may be utilized--.

Column 4

Line 5, “pear drive” should be --pearl drive--.

Column 5

Line 15, “view an alternative” should be --view of an alternative--.

Line 24, “comprises comprising” should be --comprises--.

Column 6

Line 22, “as shown In” should be --as shown in--.

Line 39, “shown In Figs.” should be --shown in Figs.--.

Column 7

Line 47, “are therefore, partially” should be --are therefore partially--.

Line 60, “are therefore, partially” should be --are therefore partially--.

UNITED STATES PATENT AND TRADEMARK OFFICE

CERTIFICATE OF CORRECTION

PATENT NO. : 7,258,232 B2
APPLICATION NO. : 10/965053
DATED : August 21, 2007
INVENTOR(S) : Judson A. Bradford et al.

It is certified that error appears in the above-identified patent and that said Letters Patent is hereby corrected as shown below:

Column 8

Line 7, "are therefore, partially" should be --are therefore partially--.

Line 32, "34d, 34d" should be --34c, 34d--.

Column 9

Line 7, "therefore, partially" should be --therefore partially--.

Column 12

Line 31, "Inserting product" should be --inserting product--.

Line 48, "dunnage:" should be --dunnage;--.

Line 63, "dunnage:" should be --dunnage--.

Signed and Sealed this

Third Day of June, 2008

JON W. DUDAS
*Director of the United States Patent and Trademark Office*